US007628952B2

(12) United States Patent
Klimas

(10) Patent No.: US 7,628,952 B2
(45) Date of Patent: Dec. 8, 2009

(54) METHOD AND APPARATUS FOR TESTING THE INTEGRITY OF A SHROUD SEAL ON A LADLE FOR A CONTINUOUS CASTING INSTALLATION

(75) Inventor: Albert J. Klimas, Oakdale, PA (US)

(73) Assignee: SMS Demag, Inc., Pittsburgh, PA (US)

( * ) Notice: Subject to any disclaimer, the term of this patent is extended or adjusted under 35 U.S.C. 154(b) by 386 days.

(21) Appl. No.: 11/784,389

(22) Filed: Apr. 5, 2007

(65) Prior Publication Data

US 2008/0246195 A1 Oct. 9, 2008

(51) Int. Cl.
*C21C 5/46* (2006.01)

(52) U.S. Cl. ..... 266/45; 164/474; 164/475; 222/603

(58) Field of Classification Search ..... 266/45, 266/236, 272; 222/590, 591, 603; 164/474, 164/475
See application file for complete search history.

(56) References Cited

U.S. PATENT DOCUMENTS 5,645,121 A * 7/1997 Barnes ..... 164/475
6,250,521 B1 * 6/2001 Assar ..... 222/590
2007/0114002 A1 * 5/2007 Blejde et al. ..... 164/480

* cited by examiner

*Primary Examiner*—Scott Kastler
(74) *Attorney, Agent, or Firm*—Clifford A. Doff

(57) ABSTRACT

Molten steel is conducted by a tubular shroud interconnecting a slide gate at a bottom tap hole of a ladle with the molten steel in an underlying tundish of a continuous caster. The flow path is confirmed to be isolated from contaminants in atmospheric air by applying a source of partial vacuum to the internal cavity of tubular shroud to allow prevailing atmospheric pressure acting on molten steel in a tundish to push molten steel upwardly in the internal cavity of the tubular shroud. A measure of the partial vacuum in the cavity of the shroud is used to assess the integrity of the gas tight seal. Before and after the integrity of the gas tight seal is determined, a three way valve is used to apply an inert gas to the volume in the cavity of the shroud.

18 Claims, 6 Drawing Sheets

METHOD AND APPARATUS FOR TESTING THE INTEGRITY OF A SHROUD SEAL ON A LADLE FOR A CONTINUOUS CASTING INSTALLATION

CROSS-REFERENCE TO RELATED APPLICATIONS

Not applicable

BACKGROUND OF THE INVENTION

The present invention relates to the continuous casting of molten steel transferred to a tundish of a continuous caster by a succession of ladles where molten steel flows from a ladle into the tundish and then into one or more continuous casting molds. Maintaining a steady flow of molten steel into the one or more continuous casting molds is essential, so as not to disturb a delicate balance of sufficient cooling for the necessary containment of a liquid steel core in the newly formed solid shell, and casting speed required for proper metal solidification. The temperature of the molten steel is critical to the casting process, and so it is imperative that a ladle is tapped for the casting process according to a schedule established to prevent the cooling of the molten steel below a desired casting temperature and to avoid the need to return the molten steel to the steel making furnace for reprocessing and the consequential stoppage of the casting process. The volume of molten steel in the tundish is selected to always maintain an operating level even when floating out of slag impurities and during an interruption to the flow of molten steel from one ladle during sequencing of ladles to the caster to reestablish the flow of molten steel by a second ladle.

A typical sequencing of ladles is started by first increasing the flow of molten steel from a first ladle before the ladle is empty to raise the liquid steel level in the tundish above an operating level. When the flow from the ladle changes from molten steel to slag, the slidegate is closed to stop the flow of slag. A pouring shroud is disconnected from the ladle slidegate and the ladle is moved away from the casting position. At the same time a second ladle is brought into the casting position and a pouring shroud is connected to the slidegate of the second ladle whereupon opening of the slidegate initiates the flow of molten steel into the tundish. The entire sequence, from the stoppage of the flow of molten steel in one ladle to the establishment of a flow of molten steel in a replacement ladle, must be completed before the liquid level in the tundish has been depleted to a certain critical level, below which the quality of the cast steel strand is adversely affected. The sequence of changing the supply of molten steel from one ladle to another is normally accomplished within a very safe time margin. Two typical devices employed in the efficient exchange of ladles are ladle cars and a ladle turret.

The present invention is addressed to the management of a ceramic pouring shroud having the general form of a tube arranged to isolate the stream of molten steel from contamination, for example, with oxygen and nitrogen in the atmosphere while passing from the ladle to the tundish. Such a ceramic pouring shroud is supported and moved by operation of a manipulator that includes synchronous movement of the ladle and ceramic pouring shroud after pressing the upper end of the ceramic pouring shroud into sealing contact the with the slide gate of the ladle. The sealing contact is maintained while the ladle is moved with into the casting position wherein the lower end of the ceramic pouring shroud is partly submerged in the molten steel in the tundish. The environment and conditions wherein these operations by the manipulator are carried out are very adverse because of the extreme temperature and the very limited amount of time available to establish and maintain the essential gaseous sealed relation between the ladle and the tundish. A need therefore exists for verifying the sufficiency of the gaseous tight seal between the ceramic pouring shroud and the ladle to prevent the ingress of atmospheric gaseous while molten steel is flowing in the shroud from the ladle to the tundish. A need also exists to establish and maintain an inert atmosphere in the cavity of the ceramic pouring shroud at least until the flow of molten steel commences in the ceramic pouring shroud but preferable continuously while molten steel flows from the ladle to the tundish.

Accordingly, it is an object of the present invention to provide a method and apparatus for verifying the sufficiency of the gaseous tight seal between the ceramic pouring shroud and a ladle for molten steel incident to the operations of a manipulator employed to hold the ceramic pouring shroud against a ladle containing molten steel.

It is a further object of the present invention to provide a method and apparatus to supply establish and maintain an inert atmosphere in the cavity of the ceramic pouring shroud at least until the flow of molten steel commences in the ceramic pouring shroud from a ladle to a tundish.

SUMMARY OF THE INVENTION

According to the present invention there is provided in a continuous caster for molten steel conducted from a slide gate at a bottom tap hole of a ladle into a tundish along a flow path confirmed to be isolated from contaminants in atmospheric air, apparatus for establishing the flow path including the combination of a ladle lift actuator to position such a ladle between a shroud assembling position and a ladle taping position for delivering molten steel into a tundish, a generally tubular shroud to communicate with such a slide gate for conducting molten steel from the bottom tap hole in the ladle, a manipulator including a shroud support moveable by manipulator actuators to displace the shroud into a gaseous sealing relation with the slide gate at the shroud assembling position, the manipulator actuators being operative to displace the generally tubular shroud while supported by the manipulator in the gaseous sealing relation with the slide gate as a unit with the ladle by operation of the lift actuator in a direction for establishing the ladle taping position wherein molten steel is conducted by the tubular shroud into the tundish beneath a surface of molten steel therein, a control for gaseous mediums to selectively connect a metal flow path in the shroud with a supply of an inert gas for purging the metal flow path of atmospheric air contaminants prior to receiving molten steel from the ladle and while conducting molten steel into the tundish, a source of partial vacuum, the control being operable to apply the source of partial vacuum to the metal flow path in the shroud, and a sensor responsive to the prevailing gas pressure of the applied partial vacuum by the control in the metal flow path for monitoring the integrity of the gaseous sealing relation with the slide gate.

According to another aspect of the present invention, there is provided 7. A method for supplying molten steel from a slide gate at a bottom tap hole of a ladle into a tundish along a flow path isolated from contaminants in atmospheric air, the method including the steps of assembling a tubular shroud in a manipulator, moving a ladle containing molten steel into a shroud assembling position, operating the manipulator to press the tubular shroud against the slide gate of the ladle to form a gas tight seal, introducing an inert gas into an internal cavity of the tubular shroud to purge atmospheric air and maintain an inert gas atmosphere therein, moving the ladle and tubular shroud in unison to ladle taping position wherein the open end of the tubular shroud is submerge in molten steel in a tundish for delivering molten steel into a tundish, terminating the supply of inert gas into an internal cavity of the tubular shroud, applying a partial vacuum to the internal cavity of tubular shroud to allow prevailing atmospheric pressure acting on molten steel in a tundish to push molten steel upwardly in the internal cavity of the tubular shroud, using a measure of the partial vacuum in the cavity of the shroud to assess the integrity of the gas tight seal, and operating the slide gate when the integrity of the gas tight seal is adequate to isolate the internal cavity of the shroud from contamination by atmospheric air while delivering molted steel into the tundish.

The method of the present invention may also be performed by the steps of engaging a tubular shroud with a manipulator, operating the manipulator to press a shroud seal at one end of the tubular shroud against a slide gate arranged for controlling hot metal flow from a bottom tap hole in a ladle, purging the molten metal flow path in the shroud with argon gas at least until the manipulator moves the shroud into a position where the shroud permeates the molten steel level in a tundish, and thereafter applying only vacuum to the molten metal flow path in the shroud, determining the integrity of the connection between the shroud seal and the slide gate as a measure of the vacuum generated in the molten metal flow path in the shroud, terminating the vacuum and applying a supply of argon gas to the molten metal flow path when the measure of the magnitude of vacuum is sufficient to verify the integrity of the shroud seal, and operating the slide gate to supply molten steel form the ladle to the tundish.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
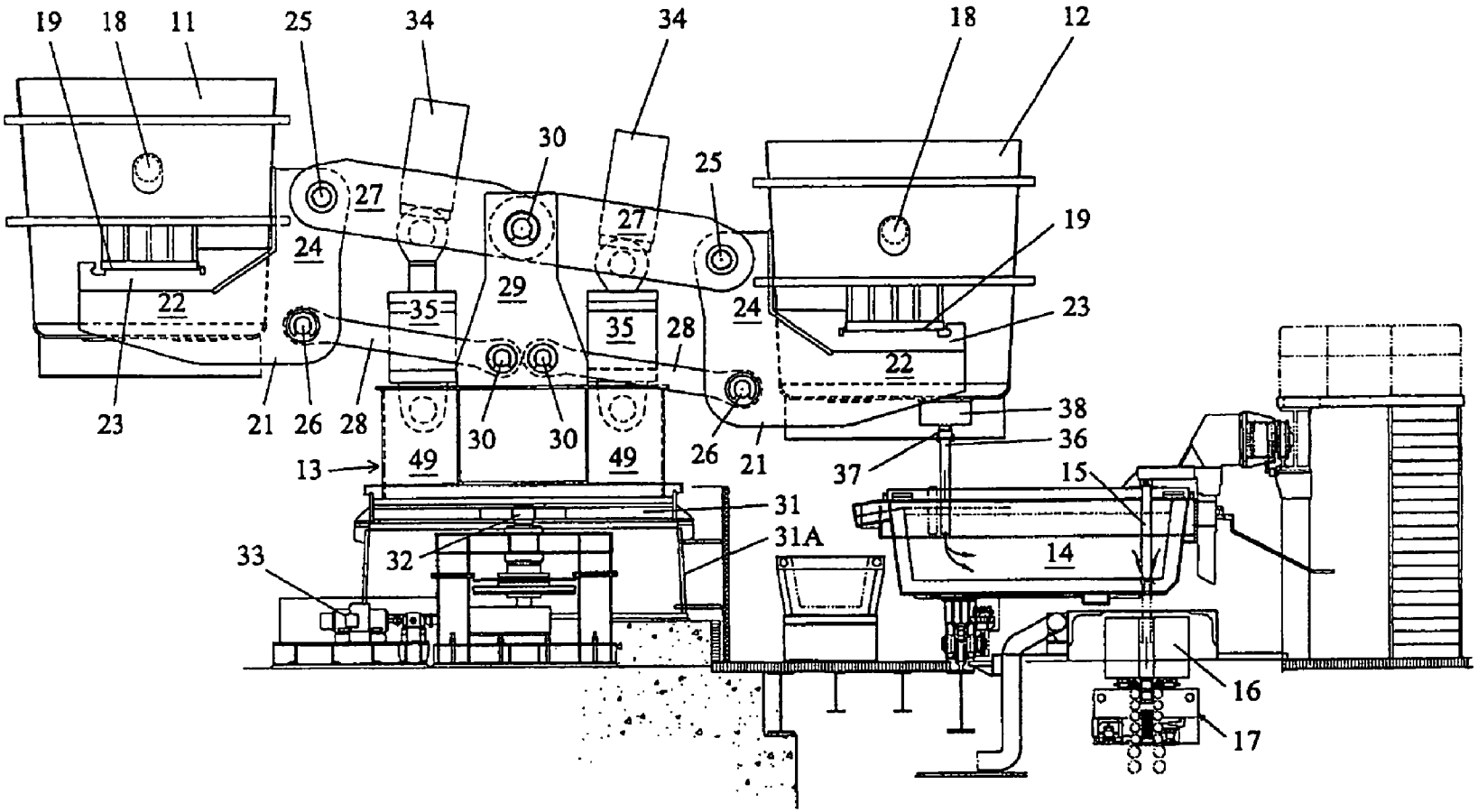
(PRIOR ART) FIGURE 1
FIG. 1 is an elevation view illustrating a ladle turret incorporating a ladle lift bearing system of the present invention for positioning of a ladle to discharged liquid metal to a tundish of a continuous caster.
Figure 2:
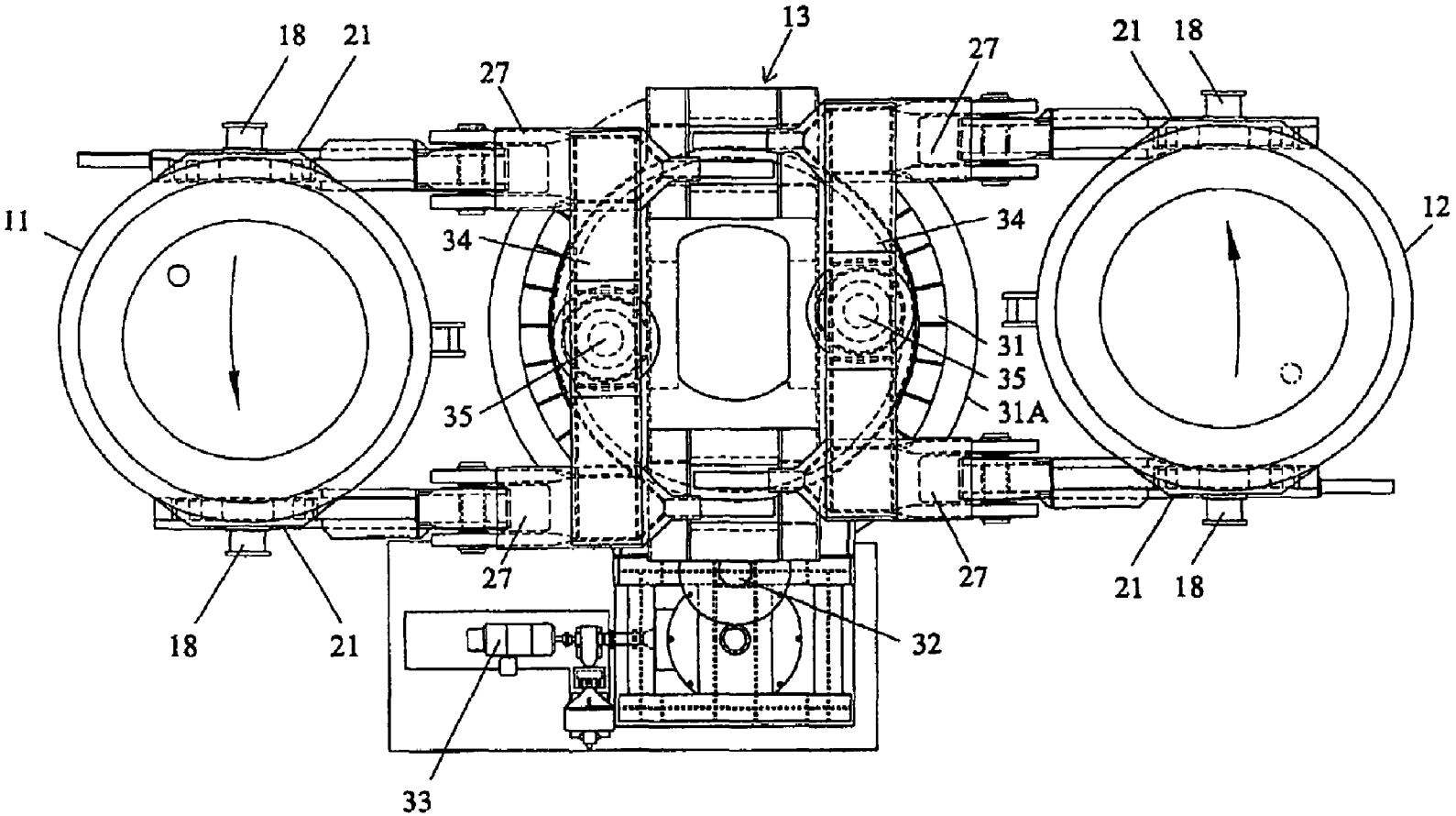
(PRIOR ART) FIGURE 2
FIG. 2 is a plan view of the ladle turret for the arrangement shown in FIG. 1.

FIGS. 1 and 2 illustrate a ladle turret arrangement for handling ladles of molten steel in a continuous casting installation. This ladle turret arraignment is suitable to practice the present invention although other well known ladle handling facilities can be used without departing from the present invention. Molten steel is delivered in ladles 11 and 12 supported by a ladle turret 13 used to rotate the ladles into and from a position directly above a tundish 14. The tundish delivers a stream of molten steel controlled by a stopper 15 to a mold 16 of a continuous caster 17. Each ladle is provided with a pair of trunnions 18 at diametrically opposite sites lying along a horizontal axis located above the center of gravity of the ladle. The trunnions are engaged by J-hooks, not shown, of a hot metal crane to transport the ladle to and from the ladle turret. Each ladle is also provided with rectangular ladle seats 19 located below the trunnions 18 for supporting the ladle on spaced apart L-shaped support arms 21 forming part of the ladle turret 13. The construction and operation of the ladles, tundish and continuous caster are per se well known in the art. The ladle support arms 21 include a horizontal leg 22 formed with an elongated recess 23 providing horizontal stop surfaces for positive retention of the ladle seats 19. Movements of the ladle support arms are mechanically synchronized for precise controlled lifting of the ladles by the use of two identical parallelogram linkages for each ladle. The parallelogram linkages for each ladle are located in parallel vertical planes containing the ladle support arms 21. The L-shaped configuration of each ladle support arm further includes a vertical leg 24 extending upward from the horizontal leg 22 and provided with vertically spaced bores joined by pivot pins 25 and 26 to a lifting arm 27 located above and parallel with a stabilizing arm 28. The free ends of the arms 27 and 28 are joined to a vertical frame 29 by pivot pins 30. The frame 29 is centrally located on a circular plate 31 and rotated on a base 31A provided with gear teeth to mesh with teeth of a drive gear 32 driven by a motor 33. The lifting arm 27 for supporting each ladle is joined by an upper link frame 34 at a location approximately midway between the pivot pins 25 and 30. The upper link frame 34 is lifted vertically by an actuator assembly 35. It is necessary to raise a ladle to an elevation suitable for installing a tubular shroud 36 to a ladle nozzle 37 forming part of a ladle side gate 38 and when necessary to a selected elevation to allow the use of an oxygen lance to melt solidified steel in the ladle exit port. After the tubular shroud is installed, the actuator assembly 35 is operated to lower the ladle until the discharge end of the tubular shroud 36 is submerged in molten steel in the tundish 14.

Figure 3:
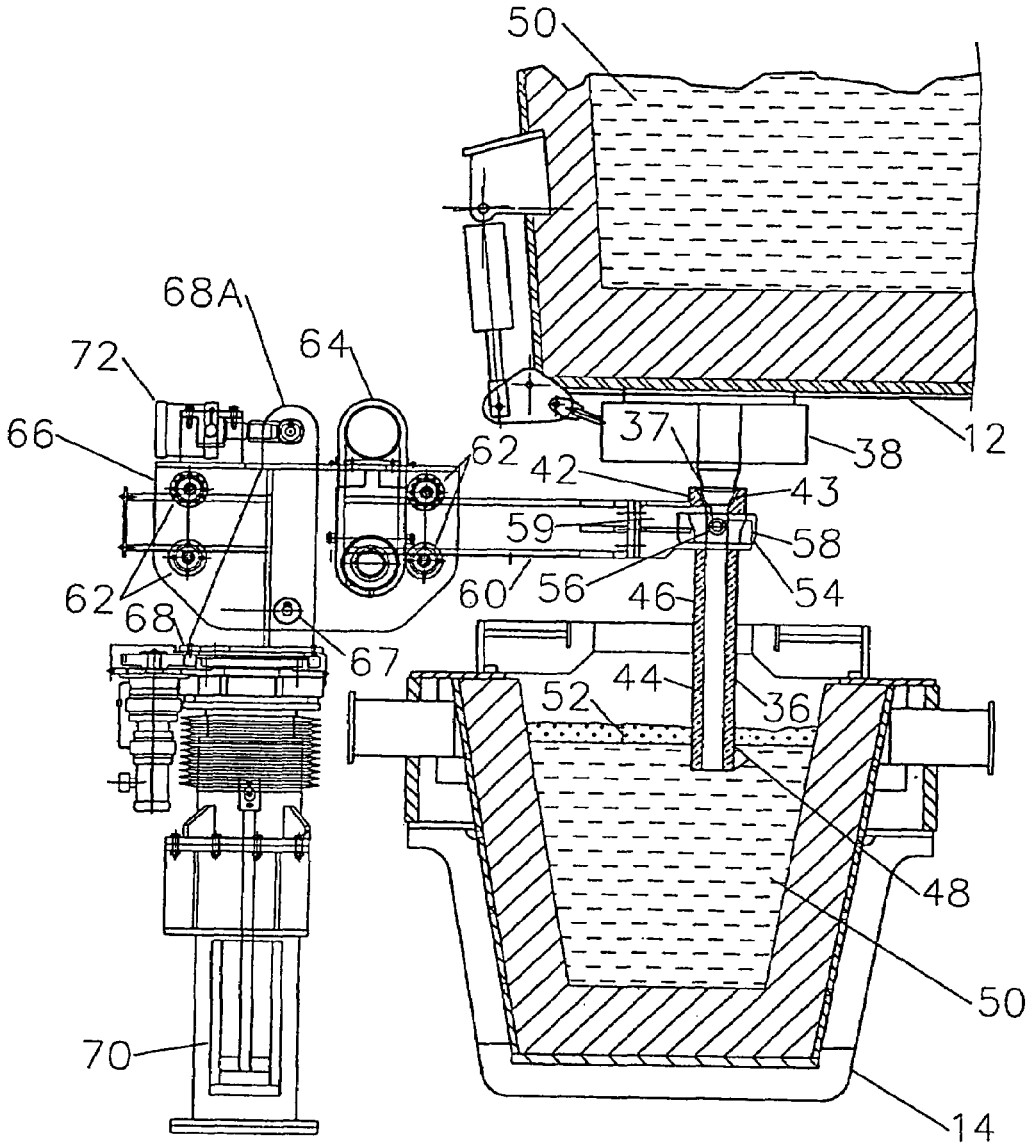
FIG. 3 is illustrates a manipulator for a tubular shroud forming part of the apparatus according to the present invention.
Figure 4A:
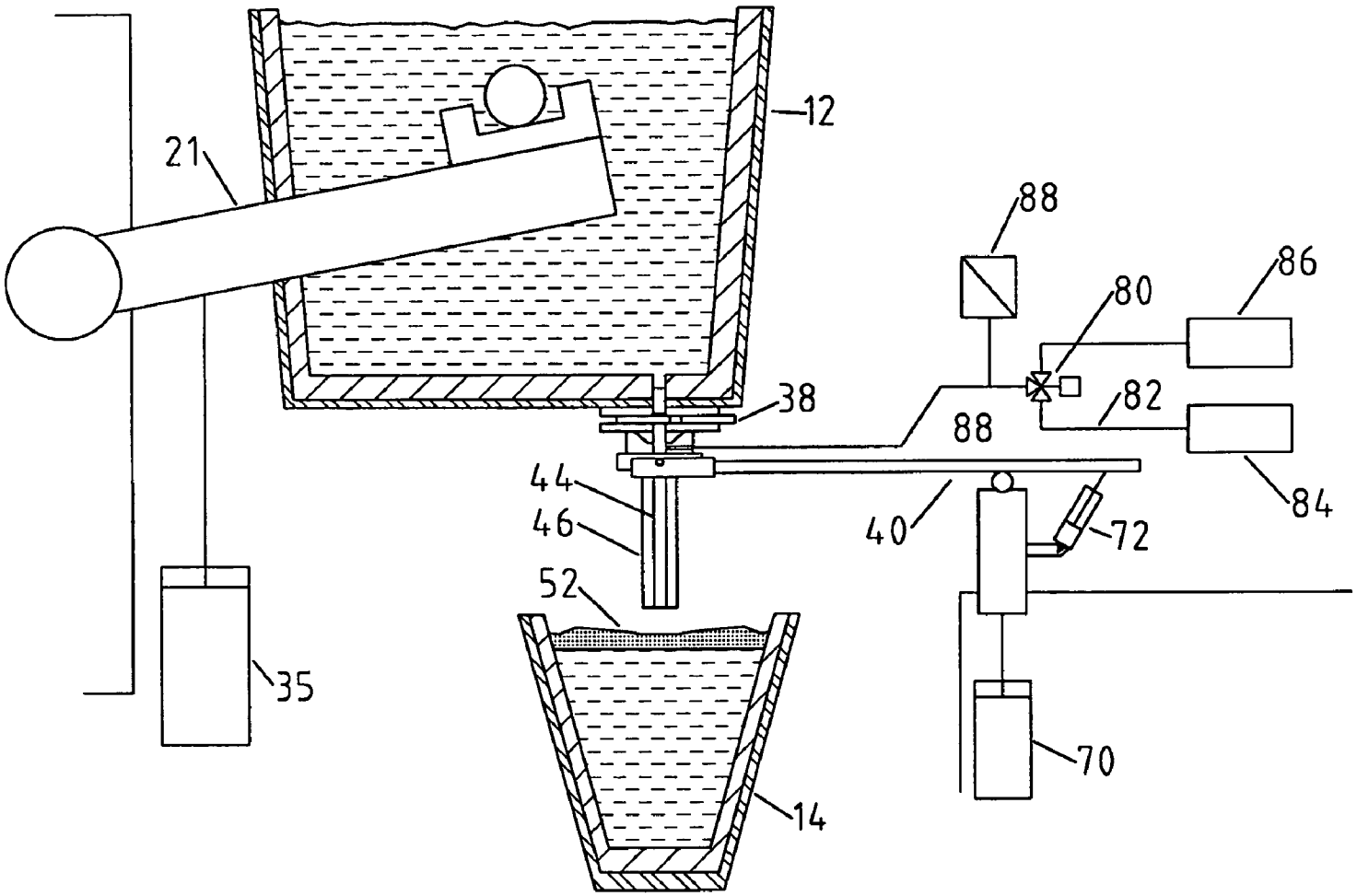
FIGS. 4A, 4B and 4C are schematic illustrations of a sequence of operation of the manipulator apparatus illustrated in FIG. 3 for installing a tubular shroud on a slide gate of a ladle according to the present invention.
Figure 4B:
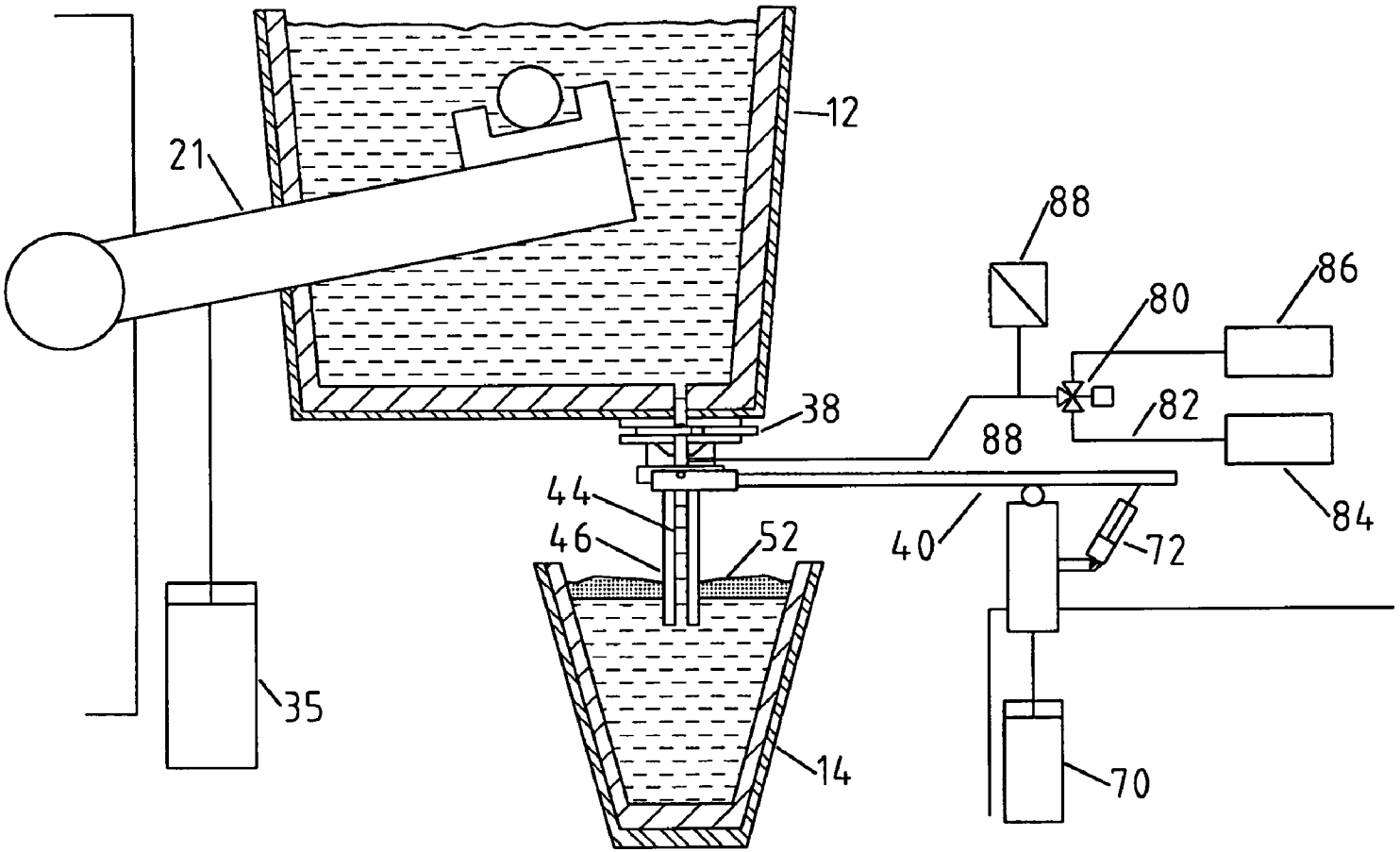
Figure 4C:
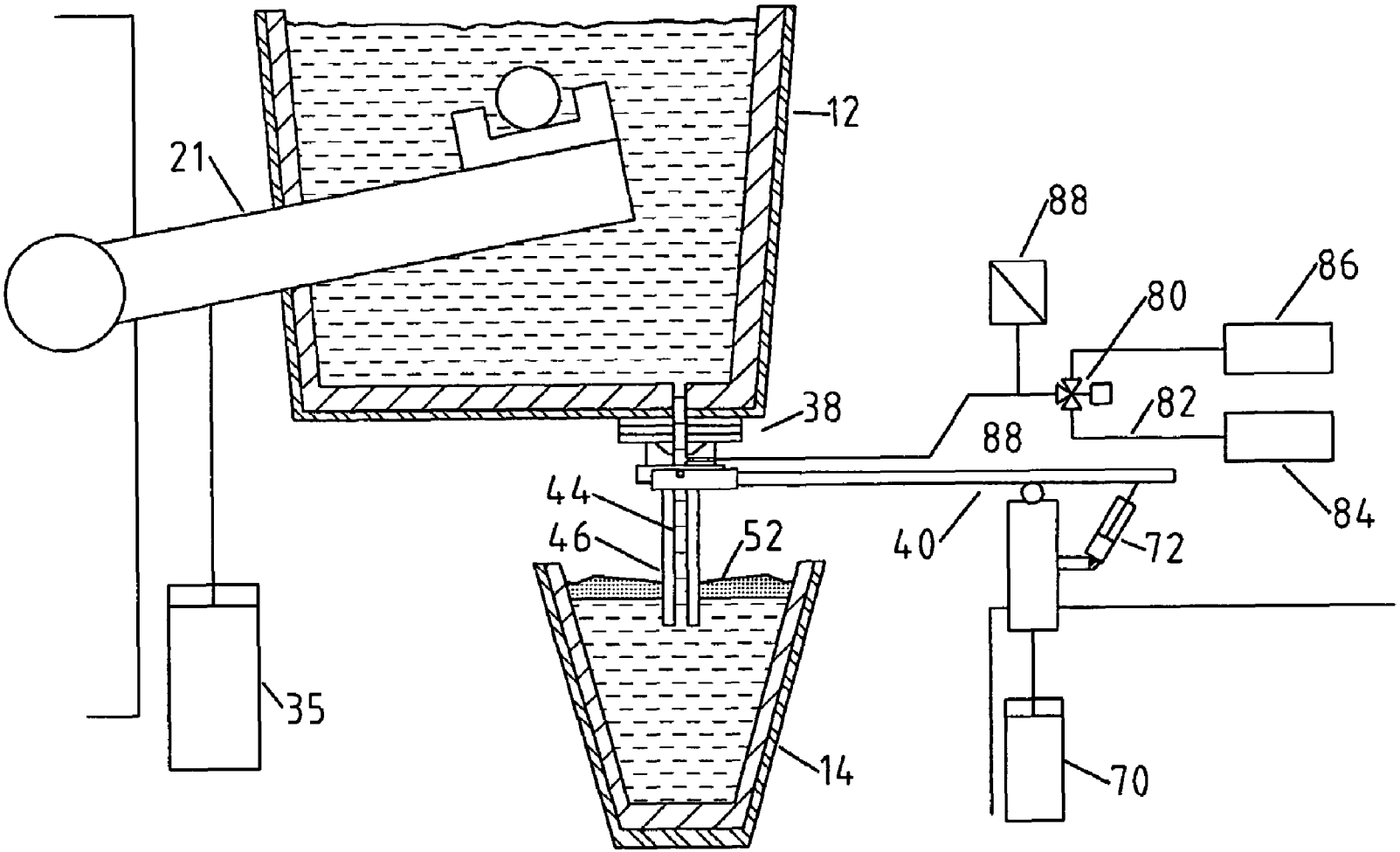

The present invention incorporates a manipulator 40 and associated apparatus to install the ceramic pouring shroud 36 and to asses the integrity of a gaseous sealed connection between the tubular shroud and a slide gate 38. Referring to FIG. 3, the shroud 36 which is made of high temperature resistant ceramic material has an enlarged, cup shaped end portion 42 on which a seal 43 of high temperature resistance sealant material such as ceramic fiber is placed for forming a gas impervious seal with the ladle nozzle 37 so that molten steel can pass to an internal duct 44 in an elongated tubular section 46 of the shroud. The shroud has an extended length sufficient to submerge an end portion 48 in a volume of molten steel 50 beneath a protective layer 52 of slag in the tundish 14. A carrier sleeve 54 has a central opening dimensioned to seat the elongated tubular section 46 and allow the cup shaped end portion 42 to engage in supporting contact with the carrier sleeve 54. The carrier sleeve 54 is provided with trunnions 56 extending from opposite lateral sides for pivotal supported in cradle arms 58 that are part of a fixture 59 mounted on the extended end of a manipulator arm 60. Opposed pairs guide rollers 62 support the manipulator arm 60 for movement in the direction of the extended length of the arm by an actuator 64 such as a motor. The rollers 62 are mounted onto a frame 66 connected by a pivot pin 67 to a base 68 that can be raised and lowered by an actuator 70 such as a piston and cylinder assembly. The base 68 includes an upstanding lever 68A joined by a clevis to the rod end of a piston and cylinder assembly 72 or other forms of and actuator which can be operated to adjust the angular relation between the manipulator arm 60 relative the base 68. The actuators 64, 70 and 72 are controlled by a programmed controller interacting with the control for actuator assembly 35 so that the ladle 12 and tubular shroud 36 move as a unit from the assembly site as illustrated diagrammatically in FIG. 4A to a generally lower position where the end portion 48 of the shroud is submerged into molten steel as illustration diagrammatically in FIG. 4B. During the time required for this unitary movement, a three way valve 80 is operated to supply an inert gas by duct 82 such as argon gas to the internal duct 44 from a source 84 sufficient to purge the volume of the duct 44 of atmospherics air. The arrangement is such that by the time of the lower end of the shroud is in close proximity to the upper surface of the layer of slag 52. The entire volume of the internal duct 44 will contain essentially only inert gas. After the end portion 48 is lowered to the desired submerged location in the molten steel, the three way valve 80 is operated to terminate the supply of inert gas and moved to a position to apply a predetermined partial vacuum previously created in a storage vessel 86. A supply of pressure resistant vessels in a serial fashion to create the needed partial vacuum in the shroud each time the integrity of the flow path in the shroud seal is confirmed to be isolated from contaminates in the atmospheric air. The applied partial vacuum is of a predetermined magnitude so that a column of molten steel is drawn upwardly in the internal duct 44 of the shroud 36 in response to the atmospheric pressure applied across the surface of the layer of slag and thus also the underlying layer of molten steel. The duct 82 is coupled to a pressure transducer 88 which supplies a corresponding electrical signal in a feed back loop by electric lines to a monitor, not shown, where data received is used to determine the length of column of molten steel and thus also the integrity of the gaseous seal between the cup-shaped end portion 42 and the ladle nozzle 37. The length of the column of molten steel in the shroud depends on the magnitude of the partial vacuum that can be generated. Thus a negative gage static pressure prevails in metal flow path in the shroud between slide gate and the upper surface of the molten steel column residing in the shroud. As shown in FIG. 4C, when the magnitude of the partial vacuum that can be generated corresponds to a predetermined value, a controller supplies a control signal to an actuator used to move the ladle slide gate 38 to an open position and at the same time the controller supplies a control signal to the three way valve 80 to shift the three way valve to a position to again to start the flow of an inert gas into the duct 44 while molten steel is in transit down the duct in the tubular shroud 36 to the tundish 14. If the required magnitude of the partial vacuum is not achieved, it is assumed the shroud 36 and/or seal 43 must be quickly replaced. For this purpose, the turret and manipulator are operated to reposition the ladle and the shroud to the relative location shown the diagram of FIG. 4A. After a replaced shroud 35 and seal 43 are installed by the manipulator on the slide gate of the ladle, the ladle and the shroud are again reposition toward the tundish as shown in FIG. 4B and explained here in before. In this procedure the seal between the tubular shroud and the nozzle if it is not correct, corrective action can be taken before starting the flow of molten steel into the tundish.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

The invention claimed is:

1. In a continuous caster for molten steel conducted from a slide gate at a bottom tap hole of a ladle into a tundish along a flow path confirmed to be isolated from contaminants in atmospheric air, apparatus for establishing the flow path including the combination of:

a ladle lift actuator to position such a ladle between a shroud assembling position and a ladle taping position for delivering molten steel into a tundish;

a generally tubular shroud to communicate with such a slide gate for conducting molten steel from the bottom tap hole in the ladle;

a manipulator including a shroud support moveable by manipulator actuators to displace the shroud into a gaseous sealing relation with the slide gate at the shroud assembling position;

the manipulator actuators being operative to displace the generally tubular shroud while supported by the manipulator in the gaseous sealing relation with the slide gate as a unit with the ladle by operation of the lift actuator in a direction for establishing the ladle taping position wherein molten steel is conducted by the tubular shroud into the tundish beneath a surface of molten steel therein;

a control for gaseous mediums to selectively connect a metal flow path in the shroud with a supply of an inert gas for purging the metal flow path of atmospheric air contaminants prior to receiving molten steel from the ladle and while conducting molten steel into the tundish;

a source of partial vacuum, the control being operable to apply the source of partial vacuum to the metal flow path in the shroud; and a sensor responsive to the prevailing gas pressure of the applied partial vacuum by the control in the metal flow path for monitoring the integrity of the gaseous sealing relation with the slide gate.

2. The apparatus according to claim 1, further including a volume of high temperature resistant sealant between the shroud seal and the slide gate.

3. The apparatus according to claim 1 wherein the control includes a gaseous control valve.

4. The apparatus according to claim 1 wherein the control includes a three way gaseous control valve.

5. The apparatus according to claim 1 wherein the source of partial vacuum comprises a pressure resistant vessel.

6. The apparatus according to claim 1 wherein the sensor includes a pressure gage responsive to negative gage static pressure prevailing in the metal flow path in the shroud.

7. A method for supplying molten steel from a slide gate at a bottom tap hole of a ladle into a tundish along a flow path isolated from contaminants in atmospheric air, the method including the steps of:

assembling a tubular shroud in a manipulator;

moving a ladle containing molten steel into a shroud assembling position;

operating the manipulator to press the tubular shroud against the slide gate of the ladle to form a gas tight seal;

introducing an inert gas into an internal cavity of the tubular shroud to purge atmospheric air and maintain an inert gas atmosphere therein;

moving the ladle and tubular shroud in unison to ladle taping position wherein the open end of the tubular shroud is submerge in molten steel in a tundish for delivering molten steel into a tundish;

terminating the supply of inert gas into an internal cavity of the tubular shroud;

applying a partial vacuum to the internal cavity of tubular shroud to allow prevailing atmospheric pressure acting on molten steel in a tundish to push molten steel upwardly in the internal cavity of the tubular shroud;

using a measure of the partial vacuum in the cavity of the shroud to assess the integrity of the gas tight seal; and operating the slide gate when the integrity of the gas tight seal is adequate to isolate the internal cavity of the shroud from contamination by atmospheric air while delivering molted steel into the tundish.

8. The method according to claim 7 including the further step of moving the ladle and shroud to the shroud assembling position when the measure of the partial vacuum in the cavity of the shroud is inadequate to isolate the internal cavity of the shroud from contamination by atmospheric air while delivering molted steel into the tundish; and thereafter, removing the existing tubular shroud from the manipulator and assembling a replacement tubular shroud in the manipulator, and again following the steps of:

operating the manipulator to press the tubular shroud against the slide gate of the ladle to form a gas tight seal;

introducing an inert gas into an internal cavity of the tubular shroud to purge atmospheric air and maintain an inert gas atmosphere therein;

moving the ladle and tubular shroud in unison to ladle taping position wherein the open end of the tubular shroud is submerge in molten steel in a tundish for delivering molten steel into a tundish;

terminating the supply of inert gas into an internal cavity of the tubular shroud;

applying a partial vacuum to the internal cavity of tubular shroud to allow prevailing atmospheric pressure acting on molten steel in a tundish to push molten steel upwardly in the internal cavity of the tubular shroud;

using a measure of the partial vacuum in the cavity of the shroud to assess the integrity of the gas tight seal; and operating the slide gate when the integrity of the gas tight seal is adequate to isolate the internal cavity of the shroud from contamination by atmospheric air while delivering molted steel into the tundish.

9. The method according to claim 7 wherein the step of assembling a tubular shroud in a manipulator includes introducing a volume of high temperature resistant sealant between the tubular shroud and the slide gate.

10. The method according to claim 7 wherein the step of introducing an inert gas and the step of applying a partial vacuum to an internal cavity of the tubular shroud includes operating a gaseous control valve communicating with an inert gas and a source of partial vacuum.

11. The method according to claim 10 wherein the gaseous control valve includes a three way control valve.

12. The method according to claim 10 wherein the source of partial vacuum comprises a pressure resistant vessel.

13. The method according to claim 7 wherein the wherein the step of using a measure of the partial vacuum in the cavity of the shroud includes measuring the negative gage static pressure prevailing in the metal flow path above the molten metal in the shroud.

14. A method for supplying molten steel to a tundish in a flow path isolated from atmospheric contaminants, the method including the steps of:

engaging a tubular shroud with a manipulator;

operating the manipulator to press a shroud seal at one end of the tubular shroud against a slide gate arranged for controlling hot metal flow from a bottom tap hole in a ladle;

purging the molten metal flow path in the shroud with argon gas at least until the manipulator moves the shroud into a position where the shroud permeates the molten steel level in a tundish; and thereafter applying only vacuum to the molten metal flow path in the shroud;

determining the integrity of the connection between the shroud seal and the slide gate as a measure of the vacuum generated in the molten metal flow path in the shroud;

terminating the vacuum and applying a supply of argon gas to the molten metal flow path when the measure of the magnitude of vacuum is sufficient to verify the integrity of the shroud seal; and operating the slide gate to supply molten steel form the ladle to the tundish.

15. The method according to claim 14 including the further step of operating the manipulator to take corrective action including reconnect a shroud seal against the slide gate.

16. The method according to claim 14 including the further step of using a shroud actuator of the manipulator to displace the shroud in a direction for establishing integrity sealing of the shroud seal with the slide gate.

17. The method according to claim 14 including the step of operating the manipulator in concert with a ladle positioner to move the ladle from a position where the tubular shroud is pressed against the slide gate of the ladle to a second position where a part of the shroud extends below the molten metal in the tundish.

18. The method according to claim 14 wherein the step of purging the molten metal flow path in the shroud with argon gas and the step of applying only vacuum to the molten metal flow path in the shroud include using a three way vale to control the respective gaseous mediums comprising the inert gas and partial vacuum.

* * * * *